US006508620B2

(12) United States Patent
Sreekanth et al.

(10) Patent No.: US 6,508,620 B2
(45) Date of Patent: Jan. 21, 2003

(54) INNER PLATFORM IMPINGEMENT COOLING BY SUPPLY AIR FROM OUTSIDE

(75) Inventors: Sri Sreekanth, Mississauga (CA); Jeffrey William Quick, Montreal (CA); William Abdel-Messeh, Middletown, CT (US); Michael Papple, Nun's Island (CA)

(73) Assignee: Pratt & Whitney Canada Corp., Longueil (CA)

( * ) Notice: Subject to any disclaimer, the term of this patent is extended or adjusted under 35 U.S.C. 154(b) by 0 days.

(21) Appl. No.: 09/858,474

(22) Filed: May 17, 2001

(65) Prior Publication Data

US 2002/0172590 A1 Nov. 21, 2002

(51) Int. Cl.[7] ..... F01D 9/06
(52) U.S. Cl. ..... 415/115; 416/97 R
(58) Field of Search ..... 415/114, 115, 415/116; 416/96 R, 96 A, 97 R

(56) References Cited

U.S. PATENT DOCUMENTS

| | | | | |
|---|---|---|---|---|
| 3,628,880 A | | 12/1971 | Smuland et al. | |
| 3,807,892 A | * | 4/1974 | Frei et al. | 415/116 |
| 4,012,167 A | | 3/1977 | Noble | |
| 4,693,667 A | | 9/1987 | Lenz et al. | |
| 4,930,980 A | * | 6/1990 | North et al. | 415/115 |
| 4,946,346 A | * | 8/1990 | Ito | 415/115 |
| 5,120,192 A | | 6/1992 | Ohtomo et al. | |
| 5,142,859 A | | 9/1992 | Glezer et al. | |
| 5,488,825 A | * | 2/1996 | Davis et al. | 415/115 |
| 5,591,002 A | | 1/1997 | Cunha et al. | |
| 5,609,466 A | | 3/1997 | North et al. | |
| 5,634,766 A | | 6/1997 | Cunha et al. | |
| 5,743,708 A | | 4/1998 | Cunha et al. | |
| 5,772,398 A | | 6/1998 | Noiret et al. | |
| 5,964,575 A | | 10/1999 | Marey | |
| 6,019,579 A | | 2/2000 | Fukuno et al. | |
| 6,036,436 A | | 3/2000 | Fukuno et al. | |
| 6,089,822 A | | 7/2000 | Fukuno | |

FOREIGN PATENT DOCUMENTS

| | | |
|---|---|---|
| EP | 0 392 664 | 10/1990 |
| EP | 1136652 | 9/2001 |
| JP | 06093801 | 4/1994 |
| JP | 10026003 | 1/1998 |

* cited by examiner

*Primary Examiner*—Edward K. Look
*Assistant Examiner*—Igor Kershteyn

(57) ABSTRACT

A stator blade assembly for a gas turbine engine has a leading edge portion with a passage communicating between a plenum and an air supply port of the outer shroud and an internal blade cooling channel communicating between passages and apertures adjacent the trailing edge of the blade. The plenum includes an impingement plate disposed a distance from the inner surface of blade platform to define an impingement cooling chamber within the plenum, and the plate includes impingement cooling apertures to direct cooling jets of air at the inner blade platform. An air flow restriction plate covers the inner end of the passage and controls the pressure and quantity of air delivered to the plenum via a compressed air metering aperture.

4 Claims, 2 Drawing Sheets

INNER PLATFORM IMPINGEMENT COOLING BY SUPPLY AIR FROM OUTSIDE

TECHNICAL FIELD

The invention relates to a stator blade assembly with a plenum inward of the inner blade platform, including a plate with platform impingement cooling apertures and a flow metering aperture to control air flow from the outer shroud through a passage in the leading edge portion and air pressure within the plenum.

BACKGROUND OF THE ART

The turbine section of a gas turbine engine includes stator blade assemblies or stationary vanes between turbine rotors with rotor blades. The stationary vanes or stator blades are circumferentially arranged in rows with an airfoil profile formed between an inner shroud and an outer shroud that contains the annular hot gas path. Vanes are exposed to hot gas delivered from the combustor and cooling of the stator vanes is extremely important for engine service life. Normally, cooling is provided by bleeding off and ducting a flow of compressed air from the low pressure stage or high pressure stage of the compressor through various passages formed within the stator vanes and exhausting the cooling air into the hot gas path at the trailing edge of the blade.

In one conventional gas turbine engine arrangement, high pressure compressed air is bled from the high pressure plenum surrounding a reverse flow combustor that is adjacent to the first or second row of stationary stator vanes or blades. High pressure compressed air is somewhat higher in temperature than the low stage compressed air. However, due to the proximity of the high pressure plenum around the combustor, it is common to simply duct the hotter high pressure air rather than incur the weight penalty of ducting cooler lower pressure air a longer distance from the low stage compressor area.

Cooling air from the stator blades eventually enters the hot gas path flowing through the turbine section. However little useful work is obtained from the cooling air. Therefore, to achieve high efficiency it is critical that the cooling air be effectively utilized to minimize the amount of cooling air and the penalty imposed on the engine by bleeding compressed air for cooling purposes.

U.S. Pat. No. 5,609,466 to North et al. shows a prior art cooled inner shroud where a portion of the cooling air that is ducted through the stator blades is used to cool the inner shroud. The inner shroud is cooled by impinging cooling air against the inner shroud surface and directing cooling air through passages in the downstream blade platform of the inner shroud to exhaust the cooling air into the gas path. For this purposes a plenum is formed on the underside or inner surface of the blade platform.

As shown in U.S. Pat. No. 5,609,466 to North et al. as well as U.S. Pat. No. 6,089,822 to Fukuno, compressed air is fed through the outer shroud into channels formed within the stator blades. The major portions of the cooling air is ducted through channels in the blade and exits into the hot gas path either at the trailing edge of the blade or partially through effusion apertures to form a cooling curtain around the exterior air foil surface and particularly the leading edge portion of the blade.

However, in order to cool the blade platform such prior art blades include a plenum formed inward of the blade platform to contain compressed air that is ducted through the blade and into the plenum. Compressed cooling air within the plenum is then ducted with a plurality of impingement holes formed in a cover plate to form jets of compressed cooling air directed to the inner surface of the blade platform. Thereafter, the air is ducted through further channels in the down stream portion of the platform to exit into the hot gas path. Optionally, the area around the plenum may be purged with cooling air also ducted through the plenum and out purged openings in the plenum enclosure to purge stagnant hot gases from around the plenum and rotating turbines then to rejoin the hot gas path.

As it is well known to those skilled in the art, the controlling of cooling air and minimization of the amount of cooling air used, is a major factor in the engine efficiency. Leakage of cooling air represents a significant penalty on the engine efficiency. In effect, the less cooling air that is needed the better and significant design effort is expended to optimize the use of cooling air.

A significant disadvantage of prior art devices is the failure to accurately meter the flaw of cooling air that passes through the channels and the blades into the plenum enclosure for impingement cooling of the blade platform area. For example in U.S. Pat. No. 5,609,466 to North et al. the flow of cooling air that eventually enters the plenum may come from various sources at various temperatures and pressures. Air may flow directly through a hole in the inner side of a tubular insert member, or may come from an annular area around the tubular member that has been cooled with air exiting numerous openings in the tubular member to cool the blade interior. Further, since North et al. uses a first tubular insert in the leading edge portion and a second tubular insert in the tubular edge portion, the flow of compressed cooling air that enters the plenum beneath the blade platform may come from four different sources, all of which have different pressures and temperatures as a result of their varying flow path.

The failure of such prior art systems to accurately meter the flow of air that enters the plenum, results in unpredictable performance and excessive leakage from the plenum through axial joints between the stator blades. The complexity involved in delivery of different flows of compressed air to the plenum makes control and predictability extremely difficult. Reliance an experimental results is unsatisfactory since the design of the blade castings has already been committed to by the time experiments can be performed.

U.S. Pat. No. 6,089,822 to Fukuno somewhat alleviates this problem by directing some of the flow from the trailing edge insert directly into the plenum. However, flow from the insert is also mixed with flow that has exited through perforations in the insert and mixing of cooling are of different temperatures and pressures inevitably occurs adding to the unpredictability of the system.

It is an object of the invention to provide highly accurate metering of cooling air delivered to the plenum on the inner surface of the blade platform to accurately and predictably deliver a controlled amount of cooling air thus enabling rational optimization of cooling air use.

It is a further of the invention to provide a simple means by which air for cooling of the blade can be accurately and predictably split between cast cooling passages within the blade itself and the plenum that supplies impingement cooling air for the inside surface of the blade platform as well as purging of adjacent areas.

It is a further object of the invention to accurately meter the flow of cooling air into the plenum on the inner surface of the blade platform by use of a highly accurate manufacturing process.

Further objects of the invention will be apparent from review of the disclosure, drawings and description of the invention below.

DISCLOSURE OF THE INVENTION

The invention provides a stator blade assembly for a gas turbine engine having: an outer shroud with an air supply port in communication with compressed air from a high pressure stage of a compressor of the engine; an inner shroud including a blade platform and a plenum enclosure defining a plenum bounded by an inner surface of the blade platform; and a blade spanning between the outer and inner shrouds.

The blade has a leading edge portion with a passage communicating between the plenum and the air supply port of the outer shroud and an internal blade cooling channel communicating between the passage and apertures adjacent the trailing edge of the blade.

The plenum includes an impingement plate disposed a distance from the inner surface of blade platform to define an impingement cooling chamber within the plenum, and the plate includes impingement cooling apertures to direct cooling jets of air at the inner blade platform. An air flow restriction plate covers the inner end of the passage and controls the pressure and quantity of air delivered to the plenum via a compressed air metering aperture. Preferably the impingement plate and flow restriction plate are manufactured as a one-piece unitary cover plate sealed to the inner surface of blade platform and covering the inner end of the passage.

A vent extends between the impingement cooling chamber and an outer surface of the blade platform venting to the hot gas path of the engine. As well, a purge bore may extend between the plenum and an outer surface of the plenum enclosure to purge adjacent areas and exhaust to the hot gas path of the engine.

In contrast to the unpredictable uncontrolled flow of cooling air in the prior art, the invention provides a very simple means to meter or control the flow of cooling air into the plenum that supplies impingement cooling air to the inner surface of the blade platform.

As a result, the pressure of air within the plenum is controlled as well as the volume of flow through to optimize use of cooling air and minimize leakage losses. A unitary cover plate is sealed on the under side or inner side surface of the blade platform and covers an inner end of the passage which delivers fresh air from the compressor through the blade itself. The plate can be accurately produced to very high tolerance with drilled holes for impingement cooling as well as a drilled hole for metering the compressed air. Casting tolerances are much higher than those achieved through drilling of a simple plate. The flow restriction hole can be accurately produced to high tolerance whereas castings generally have a much larger range of tolerance and therefore introduce higher inaccuracies in controlling the flow air.

The invention therefore capitalizes on the low cost and relatively liberal tolerance requirements of casting processes in forming passages through the blade for the bulk of the cooling air and uses an accurately drilled flow restriction hole in a cover plate to control and meter the proportion of cooling air that is split off into the plenum and used for impingement cooling of the inside surface of the blade platform.

As a result, the amount of cooling air that is directed to the plenum can be accurately controlled, modified, predicted and monitored. Experimental testing may determine the precise optimum flow split between the air delivered to the serpentine channels within the blade and to the impingement cooling plenum on the inside surface of the blade platform. Further since such components are exposed to high heat and airflows, frequently placement and maintenance are required for optimum performance. The use of a drill plate that can be removed and replaced easily significantly reduces the cost and labour involved since accuracy can be maintained by replacement of the plate and air flow adjustment can be accomplished by re-drilling the flow restriction hole if additional flow is required.

Therefore, the invention provides a simple and effective means to accurately control the proportion of cooling air that is divided between cooling channels within the blade itself and delivery to the impingement cooling plenum for impingement cooling of the inside surface of the blade platform. By accurately sizing the opening in the plate for flow restriction, the temperature and pressure of cooling air within the plenum can be accurately controlled. Optionally, in addition to impingement holes in the plate for impingement cooling of the blade platform, air can escape from the plenum through air purged bores extending between the plenum and the outer surface of enclosure to purge hot gases that are trapped between the rotating turbine components and the stationary blade plenum.

Modification of the optimum flow split is extremely simple, merely requiring the resizing of the metering aperture. Further advantages of the invention will be apparent from the following detailed description and accompanying drawings.

DESCRIPTION OF THE DRAWING

In order that the invention may be readily understood, one embodiment of the invention is illustrated by way of example in the accompanying drawings.

Further details of the invention and its advantages will be apparent from the detailed description included below.

DETAILED DESCRIPTION OF PREFERRED EMBODIMENTS

Figure 1:
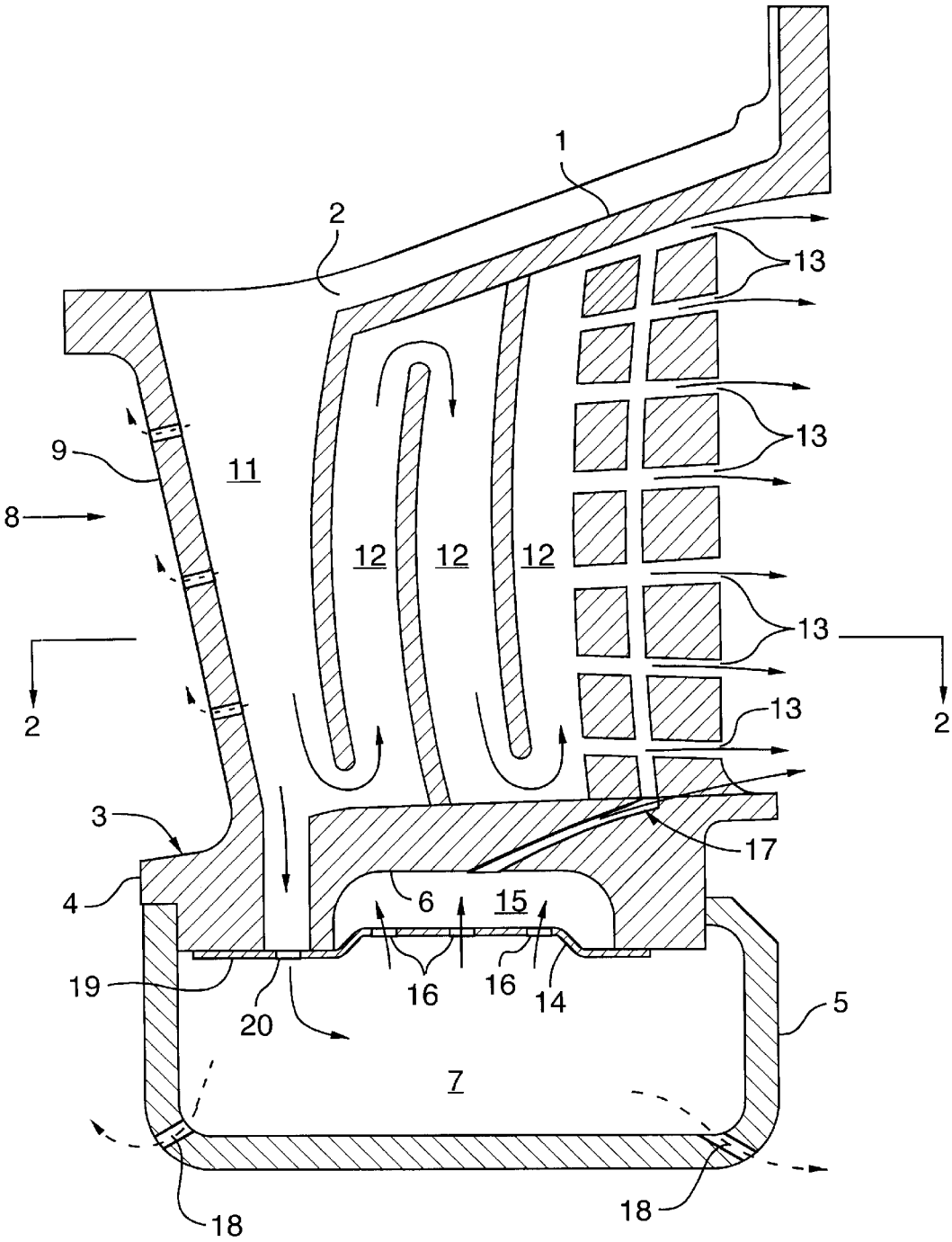
FIG. 1 is a radial-axial section through a single stator blade showing cooling air delivered through the outer shroud into passages within the blade and a metered portion of the air flow delivered through a compressed air metering aperture in a unitary cover plate into a plenum enclosure for impingement cooling of the inner surface of the blade platform.

FIG. 1 shows a stator blade assembly in accordance with the present invention for a gas turbine engine. It is considered that the general construction of a gas turbine engine is well known to those skilled in the art and consequently it is unnecessary to explain in detail the use and location of stator blade assemblies between rotary turbines downstream of a gas turbine engine combustor section.

The stator blade assembly includes an outer shroud 1 with an air supply port 2 in communication with compressed air from the high pressure stage of a compressor (not shown of the egas turbine engine. The stator blade assembly also includes an inner shroud 3, with a blade platform 4 and a plenum enclosure 5. The inner surface of the blade platform 6 and the inner surface of the plenum enclosure 5 define a plenum 7 for containing compressed cooling air.

The blade 8 extends radially between the outer shroud 1 and the inner shroud 3 and has a leading edge portion 9 and a trailing edge portion 10. The leading edge portion 9 includes a cooling air passage 11 that distributes air to the serpentine channels 12 and also communicates between the plenum 7 and the air supply port 2 in the outer shroud 1. The blade 8 includes in the embodiment illustrated a serpentine internal blade cooling channel 12 that conducts compressed air through the blade 8 and on contact with the blade, heat is transferred to the cooling air from the blade metal mass. The channel 12 communicates air flow between the leading edge portion passage 11 and a plurality of apertures 13 adjacent the trailing edge 10 of the blade 8.

Within the plenum 7 there is provided a unitary cover plate with an impingement plate portion 14 disposed a distance from the inner surface 6 of the blade platform 4. The impingement plate portion 14 defines an impingement cooling system 15 within the plenum 7, and the impingement plate portion 14 includes a plurality of impingement cooling apertures 16, that direct a series of cooling air jets (as shown in FIG. 1 by the arrows) directed toward the inner surface 6 of the blade platform 4.

The impingement cooling air from the chamber 15 is then exhausted into the hot gas path through cooling vents 17 extending between the impingement cooling chamber 15 and the outer surface of the blade platform 4 in communication with the hot gas path of the engine. Further, if required for purging purposes the plenum enclosure 5 can include purge bores 18 extending between the plenum 7 and an outer surface of the plenum enclosure 5 in flow communication with the hot gas path of the engine to purge areas around the external surfaces of the plenum enclosure 5.

An airflow restriction plate portion 19 of the unitary plate covers an inner end of the passage 11 and includes a compressed air metering aperture 20. In the embodiment illustrated, a single unitary cover plate is used to seal the inner surface 6 of the blade platform 4 and to cover the inner end of the passage 11. However, it will be understood that individual plates can be utilized, or a control nozzle can be fitted in the inner end of passage 11 with equal advantage depending on the specific configuration of the blade platform 4 and passage 11. In the embodiment illustrated however, it is extremely simple to produce a single unitary plate that covers both areas and performs the function of providing an accurately drilled metering aperture 20 to control the pressure and flow of the portion of air that is delivered to the plenum 7 from the passage 11 and as well to deliver an accurate pattern of impingement jets through cooling apertures 16.

It will be appreciated by those skilled in the art that the passage 11 and serpentine cooling channels 12 as well as apertures 13 are usually formed by casting and will have significantly larger manufacturing tolerances than the tolerance for a precisely drilled metering aperture 20. As a result the provision of the plate 19 with metering aperture 20 avoids any need to impose strict manufacturing tolerances on the casting operation since delivery of air to the plenum 7 is accurately controlled to close tolerances as a result of the precisely controlled drilling of the metering aperture 20.

Figure 2:
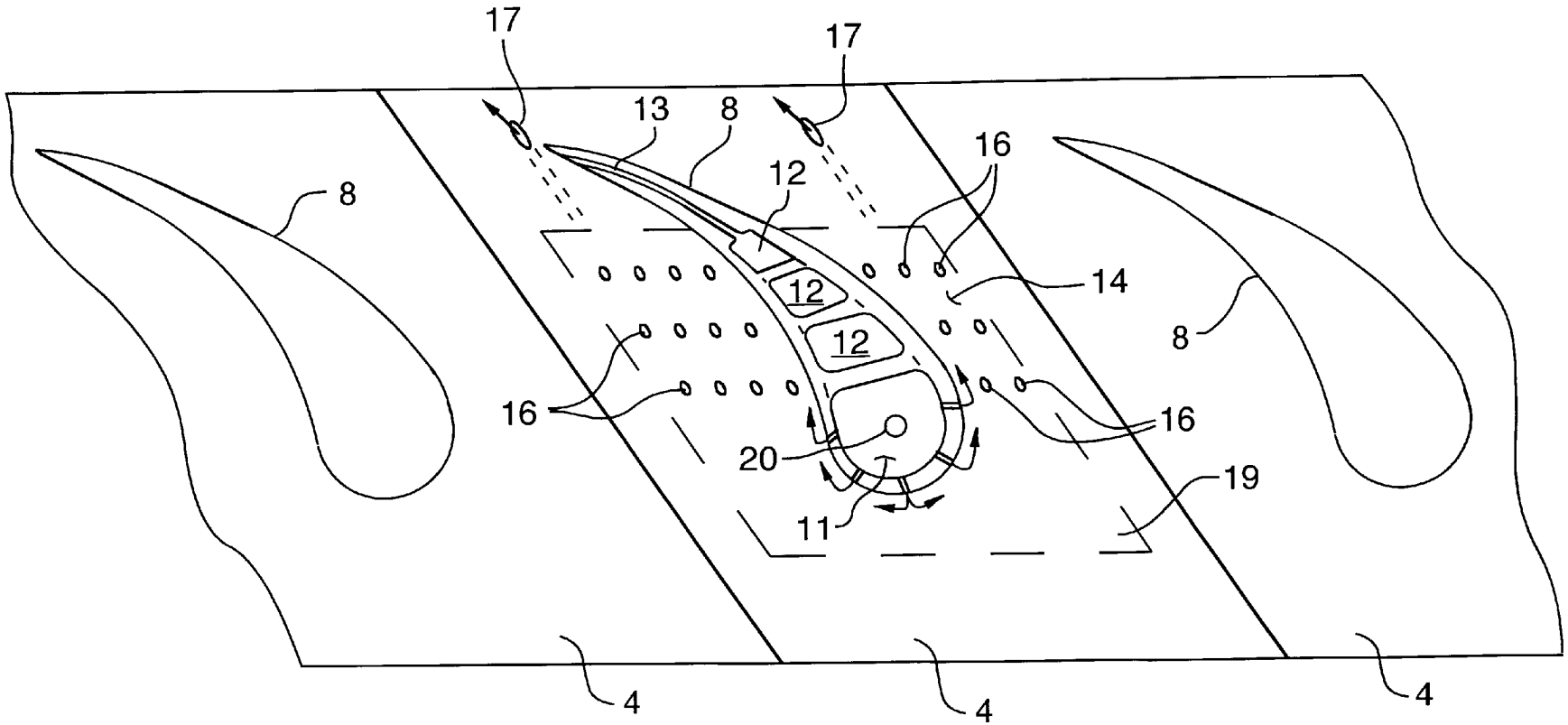
FIG. 2 is a sectional view along line 2—2 of FIG. 1.

It will be further appreciated that the precise flow split or proportion of air flow delivered through the air supply port 2 can be determined either by calculation or experimentally by varying the size of the metering aperture 20. Flow split can therefore be simply and accurately determined and optimized. By splitting the flow between cooling of the blade through passage 11 and serpentine cooling channels 12 as well as formation of an air curtain as indicated on the leading edge face shown in FIG. 2 and FIG. 1, the invention provides predictability and adjustability in contrast to the trial and error necessary in the prior art. An accurately controlled amount of compressed air can be delivered through the metering aperture 20 by sizing and controlling the aperture 20 and not requiring reliance of accurate casting of the blade itself. Modification of the flow split is very simple since the metering aperature 20 may be reamed to enlarge the size or the entire unitary plate can be replaced with a different sized aperture 20.

Although the above description relates to a specific preferred embodiment as presently contemplated by the inventor, it will be understood that the invention in its broad aspect includes mechanical and functional equivalents of the elements described herein.

We claim:

1. A stator blade assembly for a gas turbine engine, comprising:

an outer shroud with an air supply port adapted to receive compressed air from a high pressure stage of a compressor of the engine;

an inner shroud including a blade platform and a plenum enclosure defining a plenum bounded by an inner surface of the blade platform;

a blade spanning between the outer and inner shrouds, the blade having a leading edge portion and trailing edge, the leading edge portion having a passage communicating between the plenum and the air supply port of the outer shroud, the blade including an internal blade cooling channel communicating between the passage and a plurality of apertures adjacent the trailing edge of the blade;

an impingement plate disposed within the plenum, the impingement plate disposed a distance from the inner surface of blade platform thus defining an impingement cooling chamber within the plenum, the impingement plate including a plurality of impingement cooling apertures; and an air flow restriction plate covering an inner end of the passage, the restriction plate including a compressed air metering aperture.

2. A stator blade assembly according to claim 1 wherein the impingement plate and flow restriction plate comprise a unitary cover plate sealed to the inner surface of blade platform and covering the inner end of the passage.

3. A stator blade assembly according to claim 1 wherein the blade platform includes a vent extending between the impingement cooling chamber and an outer surface of the blade platform in communication with a hot gas path of the engine.

4. A stator blade assembly according to claim 1 wherein the plenum enclosure includes a purge bore extending between the plenum and an outer surface of the plenum enclosure.

* * * * *